United States Patent [19]

Hetzer

[11] Patent Number: 4,791,739

[45] Date of Patent: Dec. 20, 1988

[54] PRICE BOARD

[75] Inventor: Norbert Hetzer, Lobbach, Fed. Rep. of Germany

[73] Assignee: Esselte Meto International GmbH, Fed. Rep. of Germany

[21] Appl. No.: 42,869

[22] Filed: Apr. 27, 1987

[30] Foreign Application Priority Data

Apr. 28, 1986 [DE] Fed. Rep. of Germany ..... 3614351

[51] Int. Cl.[4] ..... G09F 3/20

[52] U.S. Cl. ..... 40/5; 40/489; 40/622

[58] Field of Search ..... 40/5, 490, 489, 518, 40/446, 10 R, 622

[56] References Cited

U.S. PATENT DOCUMENTS

| | | | |
|---|---|---|---|
| 1,380,170 | 5/1921 | Zeidler et al. | 40/518 |
| 2,334,083 | 11/1943 | Greenwald et al. | 40/518 |
| 3,089,269 | 5/1963 | McKiernan | 40/622 |
| 3,982,342 | 9/1976 | Moore | 40/5 |
| 4,262,436 | 4/1981 | Clement | 40/490 |
| 4,557,063 | 12/1985 | Bloom | 40/5 |
| 4,577,428 | 3/1986 | Trame | 40/5 |
| 4,679,339 | 7/1987 | Hetzer | 40/5 |
| 4,680,883 | 7/1987 | Stadjuhar et al. | 40/471 |

FOREIGN PATENT DOCUMENTS

| | | | |
|---|---|---|---|
| 2096377 | 10/1982 | United Kingdom | 40/446 |

*Primary Examiner*—Gene Mancene
*Assistant Examiner*—Cary E. Stone
*Attorney, Agent, or Firm*—Gerald J. Ferguson, Jr.

[57] ABSTRACT

A price board is described comprising a holder (10) for carriers for representing price information and/or other article information made up of a plurality of characters. At least the carriers for representing the individual characters at the points of the price information are cassettes (12) which are connectable to the holder (10) and each of which contains a complete set of all characters to be represented with them.

4 Claims, 3 Drawing Sheets

Figure 1:
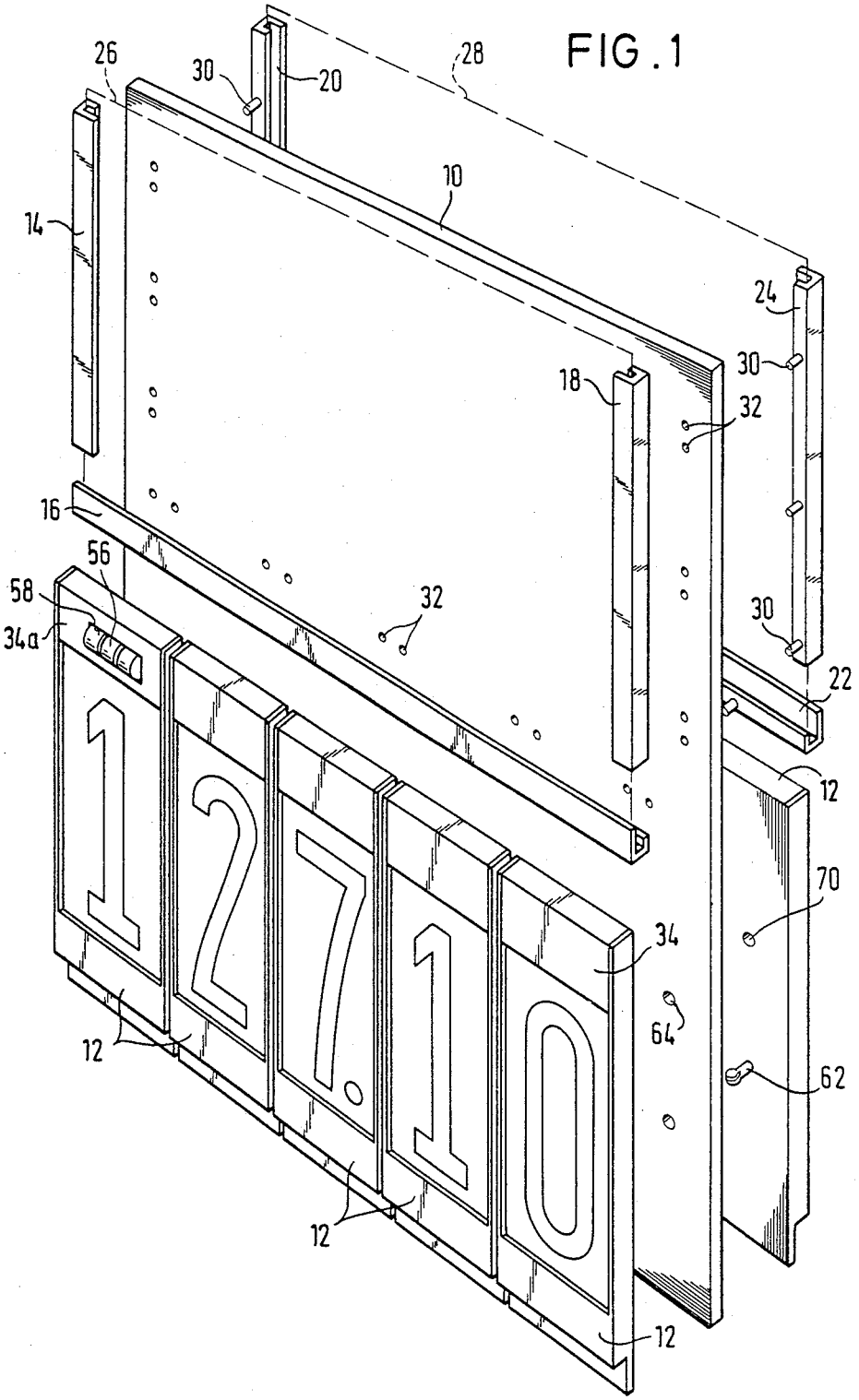

26
30
20
28
10
14
24
30
18
32
16
56
58
34a
32
30
22
12
70
34
64
62
12
12
12

PRICE BOARD

The invention relates to a price board having a holder for carriers for representing price information and/or other article information made up of a plurality of symbols or characters.

In retail shops, supermarkets and the like, it is usual to attach above racks or shelves in which goods and articles to be sold are stacked large price boards or signs on which in clearly legible large numbers and letters prices and further information on the particular articles concerned are indicated. These price boards are frequently hung above the racks and depending on requirements may have dimensions of the order of magnitude from DIN A4 to DIN A1 or larger. In the simplest case the necessary information is simply written on the price boards but as a consequence the price board can be used only once and when the price is changed must be discarded. Since price boards should also have a pleasant appearance great care must be taken in the inscription thereof and personnel specially trained for such inscription must be employed.

Large price boards adapted to be hung above racks are already known in which the price particulars can be made up by attaching individual tags bearing digits to a holder. The tags are inserted into wells which have windows open towards the observation side through which the particular digit on the tag can be read. However, with this type of price board the flexibility in representing the price particulars is very restricted because the wells define the size of the digit tags. Since to obtain an esthetic representation of the price particulars the relation between the tag size, the size of the digits applied thereto and the spacing of the digits apart is fairly definitely prescribed, it is not readily possible to use different digit sizes.

The problem underlying the invention is to provide a price board or sign of the type outlined at the beginning which can be used in very flexible manner and always retains a pleasant appealing appearance even with different types of price representation.

According to the invention this problem is solved in that at least the carriers for representing the individual characters at the digit positions of the price information are cassettes which are connectable to the holder and each of which contains a complete set of all characters to be represented with them.

With the price board according to the invention for representing a character individual cassettes can be used which for representing multi-position characters, for example price particulars, can be connected adjacent each other to the holder. With a fixedly predetermined size of the holder a plurality of large-size cassettes with which the characters can be represented correspondingly large or alternatively a plurality of small-size cassettes with a correspondingly smaller representation of the characters can be connected to the holder and of course when using smaller cassettes a greater number of positions or digits is possible. The information made up of the characters, for example the price information, always forms a closed block thus giving the desired pleasant appearance. The simultaneous use of larger and smaller cassettes with corresponding larger and smaller character representations is also possible.

To extend the possible uses of the price board according to the invention an advantageous further development provides that on both sides of the holder cassettes can be attached. When using this further development the price board can for example be disposed in the centre of racks filled with goods on both sides and on the one side price particulars can be represented for an article on one rack side and on the other side price particulars for an article on the other rack side.

An advantageous further development of the invention resides in that at the rear sides of the cassettes securing elements are attached which for connecting the cassettes to the holder can be inserted into corresponding complimentarily formed securing elements in the holder. Preferably the securing elements on the cassettes and on the holder can be inserted into each other in the manner of press studs or press fasteners.

Figure 2:
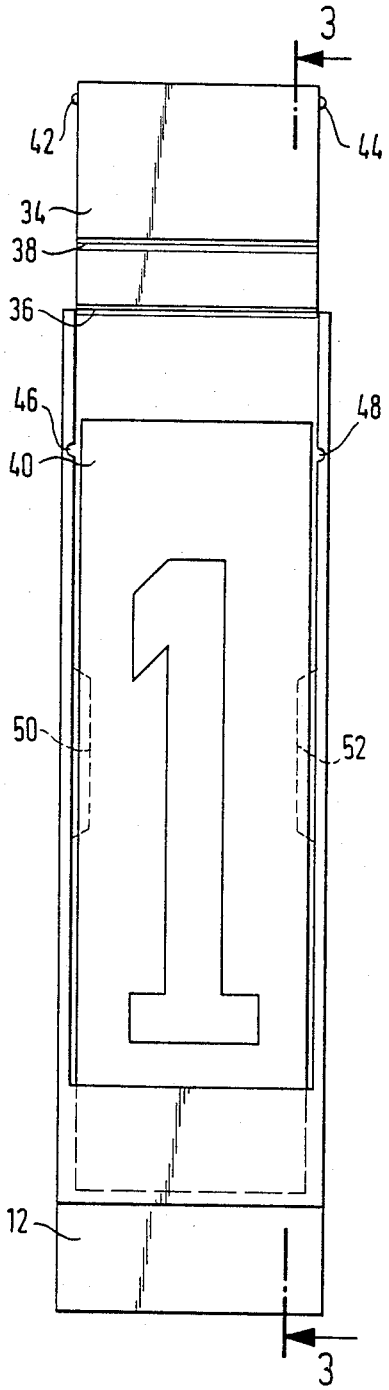
Figure 3:
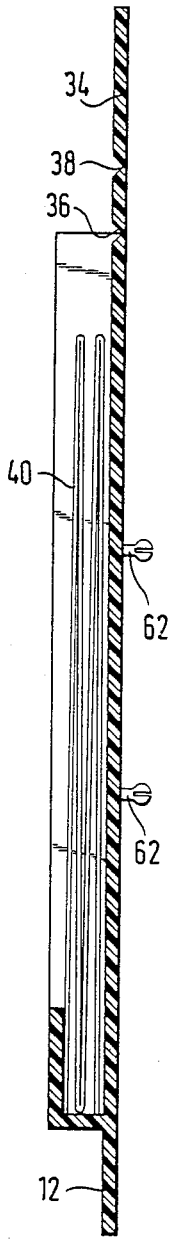
Figure 4:
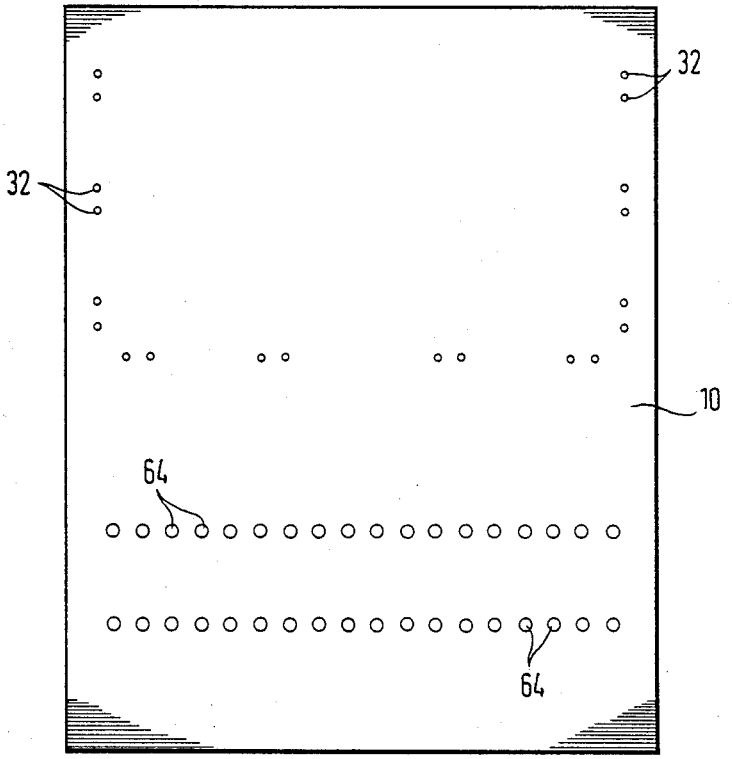
Figure 5:
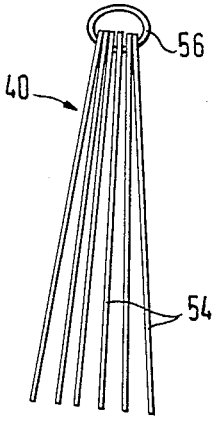
Figure 6:
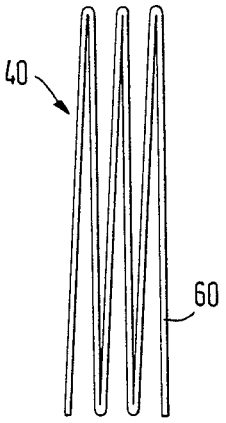

The invention will be explained by way of example with the aid of the drawings, wherein:

FIG. 1 is an exploded view of a price board according to the invention equipped on both sides with cassettes serving as information carriers, FIG. 2 is a front elevation of a cassette with opened cover, FIG. 3 is a section along the line 3—3 of FIG. 2, FIG. 4 shows the holder of the price board of FIG. 1, FIG. 5 shows a possible form of the tags or tabs carrying the set of characters to be represented and FIG. 6 shows a further possible form of the tags.

The price board illustrated in FIG. 1 comprises as basic body a holder 10 which has the form of a plane plate. Individual cassettes 12 can be detachably connected to the holder 10.

Also connected to the holder are guide strips 14, 16, 18, 20, 22, 24 which on each side of the holder can secure an information board 26, 28 shown in dashed line. In the example of embodiment illustrated the guide strips 12 to 24 are detachably connected to the holder 10 by means of pins 30 and corresponding holes 32 in the holder 10; they may however also be undetachably secured or integrally formed with the holder 10. By providing a plurality of holes 32 or a plurality of hole rows it is possible to connect to the holder 10 guide strips 14 to 24 of different lengths so that correspondingly differently sized information boards 26, 28 can be attached. The information boards 26, 28 usually bear article names or also information on the amount of a product, the origin, the nature of the goods, or the like, for which the price indicated on the price board applies.

FIG. 2 shows a cassette 12 in front elevation, the cover 34 attached at the upper end being pivoted upwardly. Since the cassette is preferably made of plastic the pivot connection between the cover and the cassette body can be made by appropriately reducing the wall thickness in the region of the bend points 36 and 38. Inserted into the cassette 12 is a tag set 40 consisting of a number of individual tags such that all characters to be represented by means of the cassette can be shown. In FIG. 2 the tag set 40 is inserted so that the number 1 is shown. For securing the tag set 40 the cover 34 is moved downwardly so that the cassette 12 assumes the appearance shown in FIG. 1. As apparent from FIG. 2 at the side edges of the cover 34 projections 42 and 44 are formed which when the cover is closed engage in corresponding depressions 46, 48 in the side walls of the cassette 12 and hold the cover 34 securely in the closed state. For securely holding the tag set 40 in the cassette at the side walls of the cassette 12 near the upper edges thereof strips 50, 52 pointing towards the cassette interior may be disposed which engage over the tag set 40 and prevent the latter from emerging at the cassette front side. Since said strips are not absolutely essential they are shown in dashed line in FIG. 2 and omitted in FIG. 1.

Examples of the configuration of the tag set are illustrated in FIGS. 5 and 6. The tag set may consist of a plurality of individual tags or tabs 54 which are held together by means of a plastic spring 56 which is led through holes near the upper edge of the tags. If this type of tag set is used cassettes 12 are employed whose covers 34 are provided with a cutout 58 as shown in the cover 34*a* of the cassette lying furthest to the left in FIG. 1. By providing this cutout 58 the space necessary for accommodating the plastic spring 56 is obtained. The tag set 40 may however also be formed as illustrated in FIG. 6, i.e. in the form of a zig-zag folded strip 60 in which the particular portion which happen to be straight perform the function of a sign. As readily apparent, with the tag set according to FIG. 5 each of the tags 54 can be brought into the frontmost position in which the desired digit is apparent whilst with the tag set according to FIG. 6 the desired digit can be brought into the frontmost position by appropriate folding of the strip 60.

As alternative to the tag sets illustrated in FIGS. 5 and 6 it is of course also possible to insert a set of individual tags into the cassette so that then as well the entire amount of characters to be shown is available.

To secure the cassettes 12 to the holder 10 projections 62 are disposed at the rear side of the cassette and can be inserted into corresponding holes 64 in the holder 10. The projections 62 have a thickened end and by providing a slit their ends can be slightly pressed together so that on insertion into the holes 64 they exert a holding force adequate to ensure securing of the cassettes 12. The holes 64 are disposed in a selected grid and the positions of the projections 62 at the cassette rear sides are chosen so that the cassettes 12 after insertion of the projections 62 into the holes 64 are contiguous without intermediate space as shown in FIG. 1. The relationships between the projections 62 and 64 are also retained when using cassettes with larger or smaller dimensions and consequently with such cassettes as well a gapless consecutive arrangement is possible.

The projections 62 at the cassette rear side are not arranged exactly over each other along the cassette centre line but are offset towards opposite sides with respect to the centre line. This means that for example the lower projection 62 of the cassette 12 furthest to the right in FIG. 4 engages into the hole lying furthest to the right in the lower row of the holder of FIG. 4 whilst the upper projection 62 of said cassette 12 engages into the third hole from the right in the upper row of the holes 64. If the holder 10 is provided with cassettes 12 from both sides, at the same location as said cassette 12 in FIG. 4 a cassette can be attached to the holder 10 from the rear, the lower projection 62 then engaging into the third hole 64 from the right in the lower row and the upper projection 62 engaging into the hole 64 furthest to the right in the upper row of the holder 10 of FIG. 4. This means that the securing elements of the cassettes do not obstruct each other when cassettes 12 are attached on both sides of the holder 10.

If desired the holder 10 can be surrounded by a frame in the manner of a picture frame, imparting to the price board a still more pleasant appearance.

In the example of embodiment illustrated the holder 10 has a thickness corresponding substantially to the length of the projections 62. This means that on attaching a cassette 12 to the holder 10 the projections 62 do not project on the other side of the holder. As a result attachment of the cassettes on the other side of the holder is not obstructed by the projections 62. With the form of the projections 62 described with thickened end however a particularly good holding effect is achieved when the holder 10 is made thinner so that the thickened end of the projections 62 emerge on the side of the holder 10 remote from the cassette. To prevent in this case obstruction of attachment of cassettes on both sides of the holder 10 the cassettes 12 comprise on their rear side corresponding recesses 70 into which the projecting thickened ends of the cassette attached to the other side of the holder 10 can penetrate. The projections 62 are formed on the cassette rear sides at the two diagonally opposite corner points of an imaginary rectangle and the recesses 70 are formed on the two remaining corner points of the rectangle likewise diagonally opposite. In this manner even when using a very thin holder 10 cassettes 12 can be attached from both sides of the holder 10 so that a price board which can be read from both sides is obtained.

I claim:

1. Price board comprising a holder for carriers for representing multi-digit price information and/or other article information made up of individual characters, characterized in that at least the carriers for representing the individual characters at the points of the price information are cassette (12) which are connectable to the holder (10) on both sides of the holder and each of which contains a complete set of all characters to be represented with them, said cassettes including rear sides with securing elements formed thereon for connecting said cassettes to said holder and which are insertable into corresponding complimentarily formed securing means in the holder, said securing elements are formed on two diagonally opposite corner points of an imaginary rectangle on the rear side of the cassettes and the two remaining corner points of the rectangle on the rear side of the cassettes are formed with recesses to facilitate connection of cassettes to both sides of said holder.

2. Price board according to claim 1, characterized in that the securing elements (62, 64) on the cassettes (12) and on the holder (10) are insertable into each other in the manner of press studs.

3. Price board according to claim 2, characterized in that the securing elements (62) on the rear sides of the cassettes (12)are projections (62) with resiliently formed ends and that the securing elements (64) on the holder (10) are holes.

4. Price board comprising a holder for carriers for representing multi-digit price information and/or other article information made up of individual characters, wherein at least the carriers for representing the individual characters at the points of the price information are cassettes which are connectable to the holder on both sides of the holder and each of which contains a complete set of all characters to be represented with them, said cassettes including rear sides with securing elements formed thereon for connecting said cassettes to said holder and which are insertable into corresponding complimentarily formed securing means in the holder, said rear sides of said cassettes are also formed with means to permit cassettes to be connected on both sides of the holder without interference of the securing elements and the rear sides of the cassette.

* * * * *